United States Patent [19]

Rosan, Jr.

[11] 4,240,393

[45] Dec. 23, 1980

[54] SELF LOCKING VALVE GUIDE

[75] Inventor: José Rosán, Jr., Newport Beach, Calif.

[73] Assignee: Rosan, Inc., Newport Beach, Calif.

[21] Appl. No.: 6,341

[22] Filed: Jan. 25, 1979

[51] Int. Cl.[3] ..... F01L 3/08

[52] U.S. Cl. ..... 123/188 GC; 308/4 R

[58] Field of Search ..... 29/156.7 R, 156.4 WL; 123/188 GC; 308/5 V, 4 R, 3 R

[56] References Cited

U.S. PATENT DOCUMENTS

| | | | |
|---|---|---|---|
| 2,813,524 | 11/1957 | Brenneke | 123/188 GC |
| 4,008,695 | 2/1977 | Bouquet | 123/188 GC |

*Primary Examiner*—Frederick R. Schmidt

[57] ABSTRACT

A valve guide for installation in cylinder heads of internal combustion engines which includes a hollow body, a beveled pilot flange, a locking flange to flow material into, an annular groove to receive and pack displaced material and lock the valve guide to the workpiece to prevent axial movement.

6 Claims, 4 Drawing Figures

SELF LOCKING VALVE GUIDE

FIELD OF THE INVENTION

This invention relates to valve guides for use in cylinder heads of internal combustion engines, more particularly it refers to valve guides that are used in cylinder heads constructed of aluminum, magnesium or other non-ferrous materials.

Description of the Prior Art

The installation of valve guides in cylinder heads is a particular problem since alignment and resistance to loosening and pullout are critical to proper engine performance.

In the past valve guides were often made an integral part of the cylinder head by inserting them into dies or molds and casting the cylinder head around them. After cooling alignment with valve seat is achieved by drilling out the center of valve guide in proper angular relationship. This requires extreme precision in the drilling and positioning of parts and is a difficult operation in high volume engine manufacture.

Prior solutions to this problem have been the insertion of valve guides into predrilled holes in the cylinder head after the casting operation. In this method, positioning tools were used to insert and align the valve guide and the valve seat around a central axis along with the valve moved where the engine was operating. These precision insertion and aligning operations usually involved either cryogenic techniques for cooling the parts prior to insertion, heating of the cylinder heads prior to insertion or combinations of heating and chilling to achieve a use tight fit. A use-tight fit after insertion and alignment is necessary for operation of the engines. Loose valve guides could result in valve misalignment, excessive valve seat wear, valve damage and resulting loss of engine compression. Applicant has previously filed application Ser. No. 150,973 filed Oct. 13, 1978 disclosing a self locking valve seat insert that solves the problem in the case of the valve seat.

OBJECT OF THE INVENTION

It is an object of the present invention to provide a solution to the problem in the case of valve guide and provide a valve guide that can be easily aligned and inserted in a predrilled hole in the cylinder head and locked into position without chilling the valve guides or heating the cylinder head.

Another object of the invention is to provide a more simple and improved valve guide.

A further object of the invention is to provide a valve guide that is self locking upon alignment and installation into a fixed position.

Still a further object is to provide a valve guide that can be easily removed and replaced utilizing standard tools available in the automotive industry.

Other objects and advantages will appear from the following description of and illustrative embodiments of the present invention.

DESCRIPTION OF THE PREFERRED EMBODIMENTS

Figure 1:
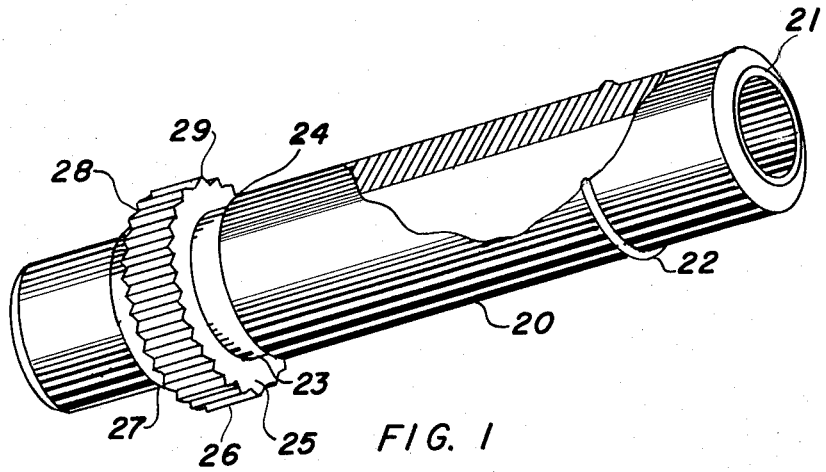
FIG. 1 is a cutaway prospective view of the device embodying feature of the present invention.
Figure 2:
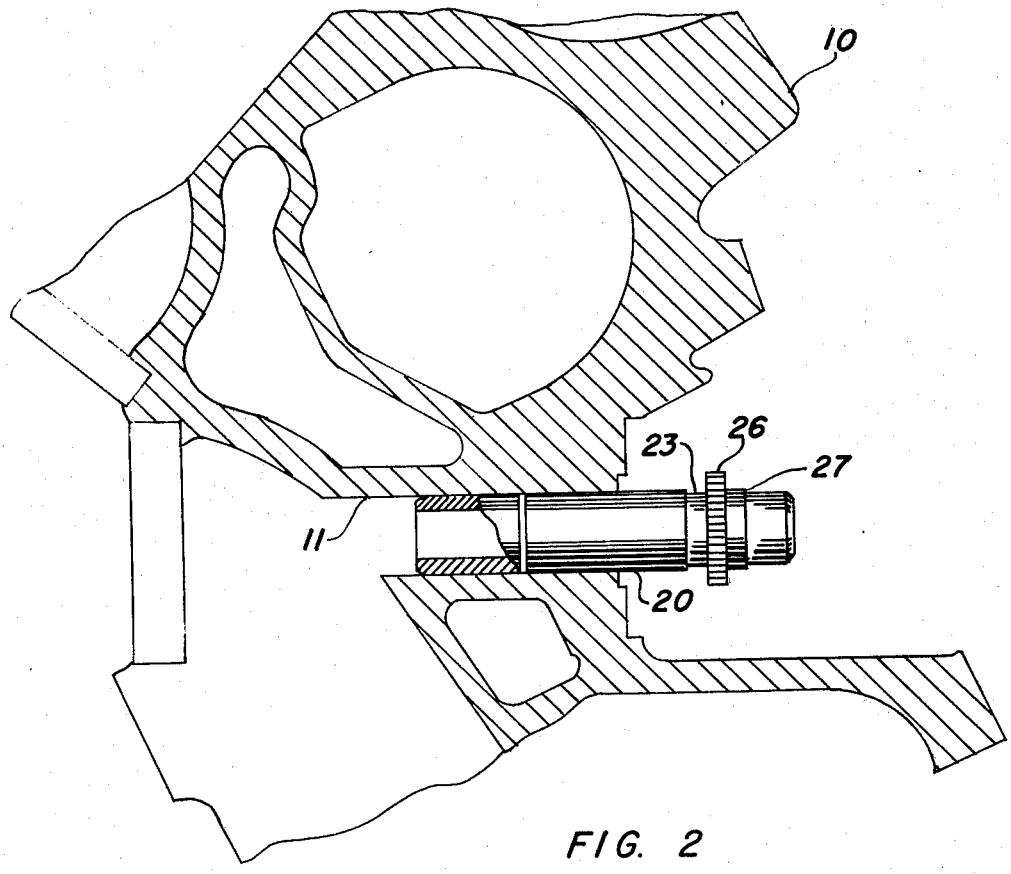
FIG. 2 is a view in elevation of the valve guide of this invention partially installed in a cylinder head.
Figure 3:
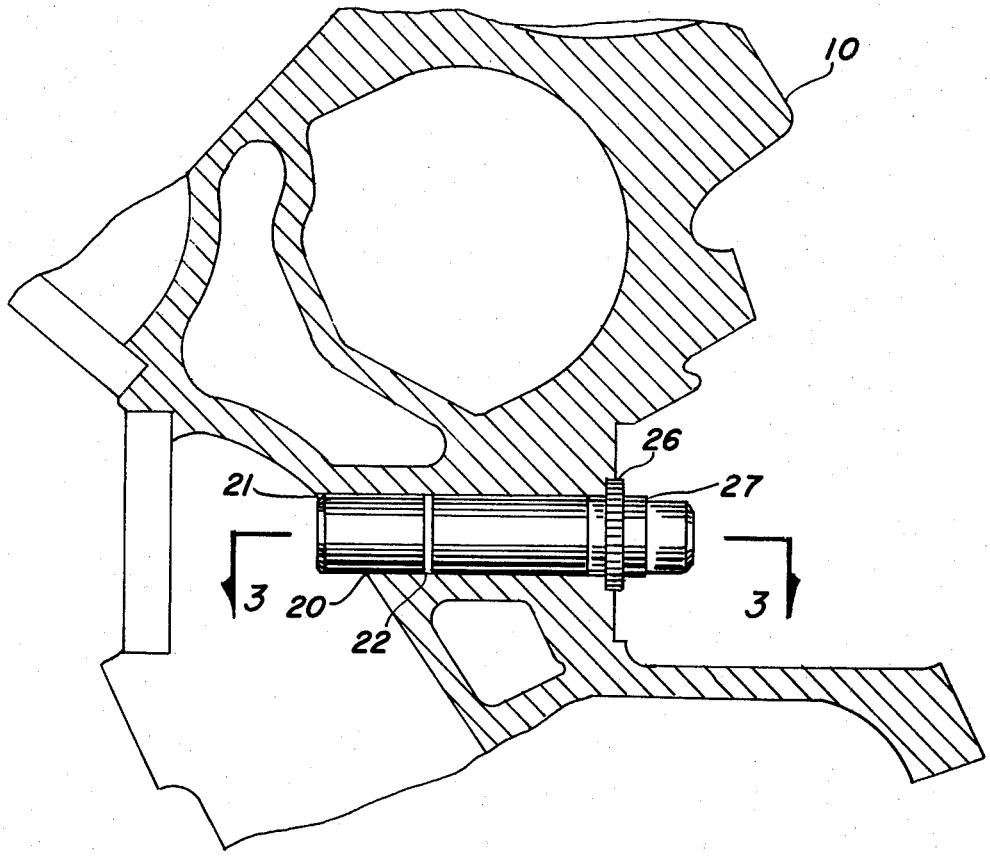
FIG. 3 is a view in elevation of the valve guide of this invention installed in a cylinder head.

The structure selected for illustration is shown in association with a cylinder head housing 10 which has been suitably bored 11 for reception of a customary valve guide. The valve guide of this invention is shown in FIG. 2 partially installed.

The valve guide consists of a cylindrical body 20 containing a beveled pilot edge 21 at the foreward end thereof to lead the valve guide easily into the prebored hold during installation.

Located back from the lead edge at a distance greater than ¼ of the total length of and less than ⅓ of said distance in an annular ring 22 which is dimensioned to size the prebored hole and position the guide in relation to the valve insert. While the preferred embodiment includes the annular ring 22, it may be omitted and the prebored hole drilled to receive the body 20.

An annular groove 23 is formed by shoulder 24 of cylinder body 20 and a forming shoulder 25 of serrated (28, 29) locking flange 26 located near the opposite end of cylindrical body 20. The balance of the cylindrical body 20 may be shaped as in 27 to accommodate an installation tool or other device, not shown.

Figure 4:
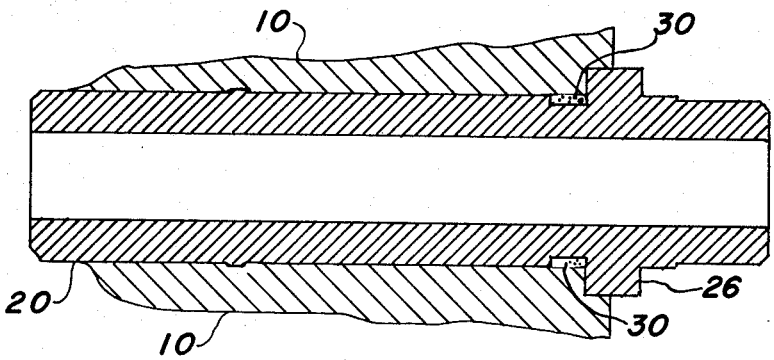
FIG. 4 is a magnified cross-section through 3—3 of FIG. 3.

The diameter of the forming shoulder 25 of the locking flange 26 is selected to flow the appropriate amount of metal from cylinder head 10 so as to pack annular groove 23 with sufficient material 30, FIG. 4 to form a metal to metal lock which would prevent axial movement and resist rotational movement.

Under certain operating conditions where little or no rotational stress is placed upon the guide or where rotational movement is not objectionable, the serrations may be omitted from the locking flange. In those instances (not illustrated) the locking flange shoulder 25 is of a greater diameter than that of the annular ring 22 or the cylinder body 20 if annular ring 22 is not used. The diameter is selected to flow the appropriate amount of metal from cylinder head 10 so as to pack annular groove 23 with sufficient material so as to form a metal to metal lock to prevent axial movement and resist rotational movement.

Various changes may be made from the embodiment of the invention herein specifically described without departing from or sacrificing any of the advantages of the invention as defined in the appended claims.

I claim:

1. A self-locking valve guide for installation on a cylinder head comprising in combination a cylindrical body means, a beveled pilot means at one end thereof, an annular groove, an annular serrated locking flange means, installation means at the end opposite the pilot means, wherein metal is displaced from the cylinder head and compressed into said annular groove by said locking flange means to form a metal to metal lock of the valve guide into said cylinder head.

2. A self locking valve guide as described in claim 1 in which the annular locking flange means is serrated.

3. A self locking valve guide as described in claim 2 in which the forming shoulder of the locking flange is of an appropriate diameter to flow sufficient material from the cylinder head into the annular groove to lock the guide into place when installed.

4. A self locking valve guide for installation in a cylinder head valve guide comprising in combination, a cylindrical body means, a beveled pilot means at one end thereof, an annular ring located at no less than ¼ nor greater than ⅓ the distance from the pilot end to the other end of the guide, an annular groove, formed by a serrated locking flange;

installation means at the end opposite the pilot means; and wherein metal is displaced from the cylinder head side walls packed into said annular groove by said serrated locking flange to form a metal to metal lock of the valve guide into said cylinder head.

5. A self locking valve guide as described in claim 4 in which the annular locking flange means is serrated.

6. A self locking valve guide as described in claim 5 in which the forming shoulder of the locking flange is of an appropriate diameter to flow sufficient material from the cylinder head into the annular groove to lock the guide into place when installed.

* * * * *